US005738424A

United States Patent [19]

Katz et al.

[11] Patent Number: 5,738,424

[45] Date of Patent: Apr. 14, 1998

[54] APPLIANCE BACKSPLASH ASSEMBLY

[75] Inventors: Jonathan Marc Katz; Scott Alan Calvert; Seana Michelle Hopson; Reynaldo Estrellado, Jr.; Lowell Douglas Hughes, all of Louisville, Ky.

[73] Assignee: General Electric Company, Louisville, Ky.

[21] Appl. No.: 416,172

[22] Filed: Apr. 4, 1995

[51] Int. Cl.[6] ..... G12B 9/00

[52] U.S. Cl. ..... 312/293.3; 312/279; 312/223.1

[58] Field of Search ..... 312/293.3, 293.2, 312/293.1, 140.4, 279, 248, 263, 265.5, 265.6, 257.1, 223.1, 228; 220/4.02

[56] References Cited

U.S. PATENT DOCUMENTS

| | | | |
|---|---|---|---|
| 3,173,730 | 3/1965 | Collins | 312/279 X |
| 3,253,874 | 5/1966 | Czech | 312/279 X |
| 4,003,613 | 1/1977 | Oakley | 312/293 |
| 4,288,133 | 9/1981 | Deatherage | 312/279 |
| 4,507,942 | 4/1985 | Hirose et al. | 312/223.1 X |
| 4,765,698 | 8/1988 | Dooley | 312/248 |
| 4,798,424 | 1/1989 | Coates et al. | 312/257 R |
| 5,350,140 | 9/1994 | Ripley et al. | 312/257.1 X |
| 5,375,921 | 12/1994 | Tupa et al. | 312/279 X |

FOREIGN PATENT DOCUMENTS

| | | | |
|---|---|---|---|
| 53-22948 | 3/1978 | Japan | 312/265.6 |

*Primary Examiner*—Jose V. Chen
*Assistant Examiner*—Janet M. Wilkens
*Attorney, Agent, or Firm*—H. Neil Houser

[57] ABSTRACT

An appliance backsplash assembly includes an appliance housing with a top member. A control housing assembly includes a rear wall and a pair of end caps mounted adjacent the rear portion of the top member. The control housing also includes a control panel assembly with a mounting plate and a cover. The mounting plate has tabs spaced across its bottom edge with slots therein. The cover includes tabs spaced apart across its bottom edge and received in the slots in the mounting plate tabs. The mounting plate tabs are received slots in the rear portion of the top member so that the mounting plate can be pivoted to a position exposing one of its faces. Controls are mounted to the mounting plate through that face to be removable when that face is exposed.

2 Claims, 3 Drawing Sheets

Fig. 1
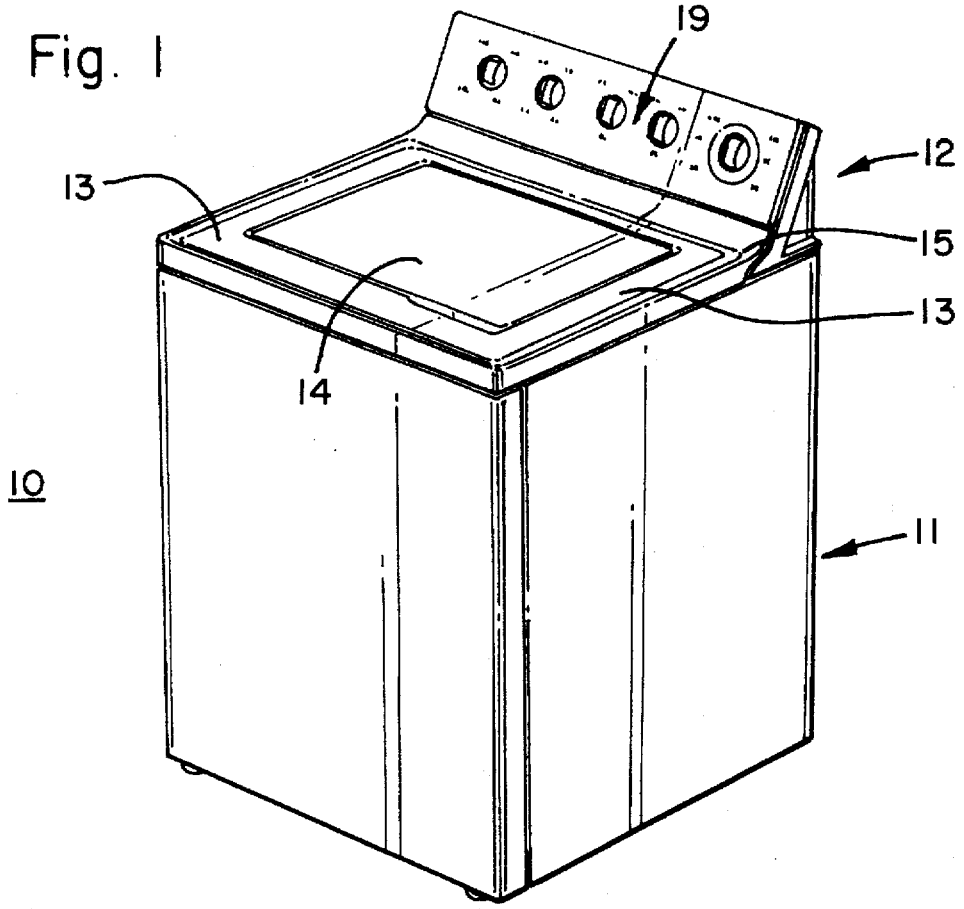
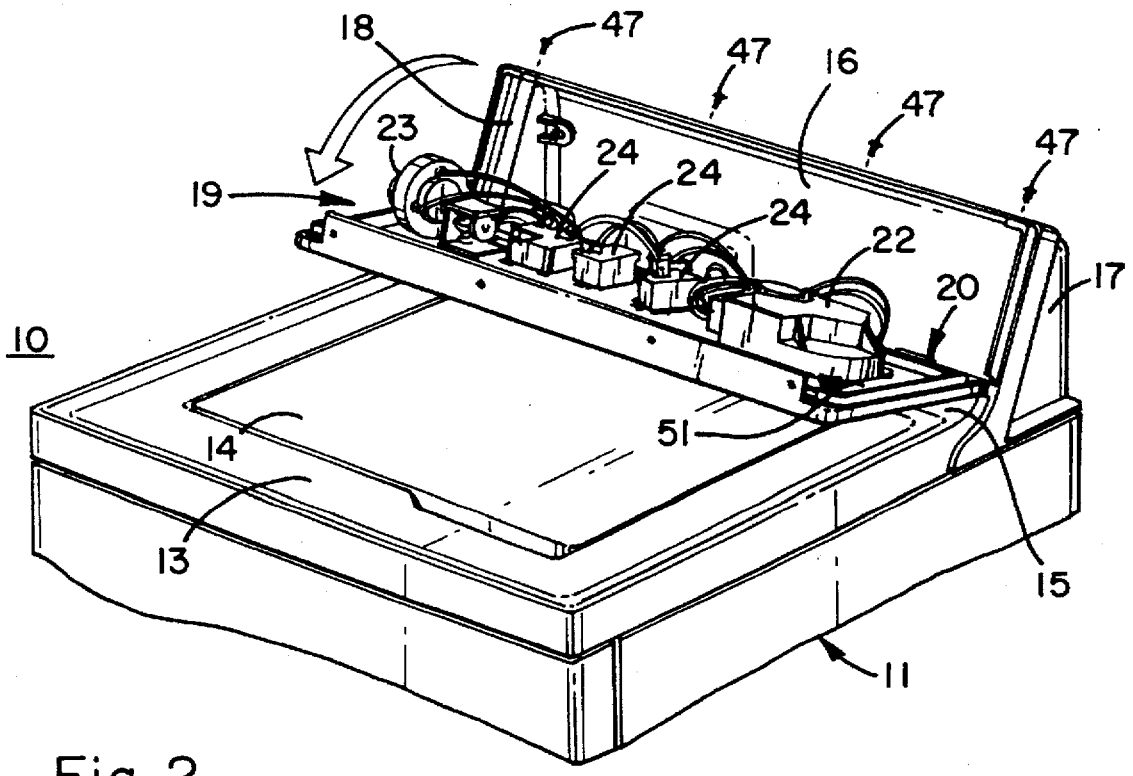
Fig. 2

APPLIANCE BACKSPLASH ASSEMBLY

BACKGROUND OF THE INVENTION

Many major domestic appliance, such as clothes washers and dryers for example, include a control housing, generally referred to as a backsplash, in which various controls for the machine are mounted. Generally it is necessary to remove at least one member of the backsplash in order to gain access to the controls for repair or replacement. Often it is the back or rear wall of the backsplash which must be removed. This necessitates that the appliance be moved away from any adjacent wall, which greatly complicates the process of repairing any control.

It is an object of this invention to provide an improved appliance backsplash assembly.

It is another object to provide such an improved assembly in which the front portion of the backsplash can be pivoted away from the remainder of the backsplash to expose the controls, which are mounted to be removable when so exposed.

SUMMARY OF THE INVENTION

In accordance with one embodiment of this invention an appliance backsplash assembly includes an appliance top member. A control housing includes a rear wall and a pair of spaced apart end caps mounted adjacent to the rear portion of the top member. The control housing also includes a control panel assembly mounted for pivotal movement between a closed position, engaging the rear wall and end caps, and an open position away from said rear wall and end caps. The control panel assembly includes a mounting plate having one face exposed when the control panel is in its open position. At least one control is mounted to the mounting plate from the one face to be removable when the control panel assembly is in its open position.

BRIEF DESCRIPTION OF THE DRAWINGS

FIG. 1 is a simplified front perspective view of an automatic clothes washing machine incorporating one embodiment of the present invention.

FIG. 2 is a fragmentary perspective view similar to FIG. 1, but showing the control panel assembly in its open position.

DETAILED DESCRIPTION OF PREFERRED EMBODIMENT

Figure 3:
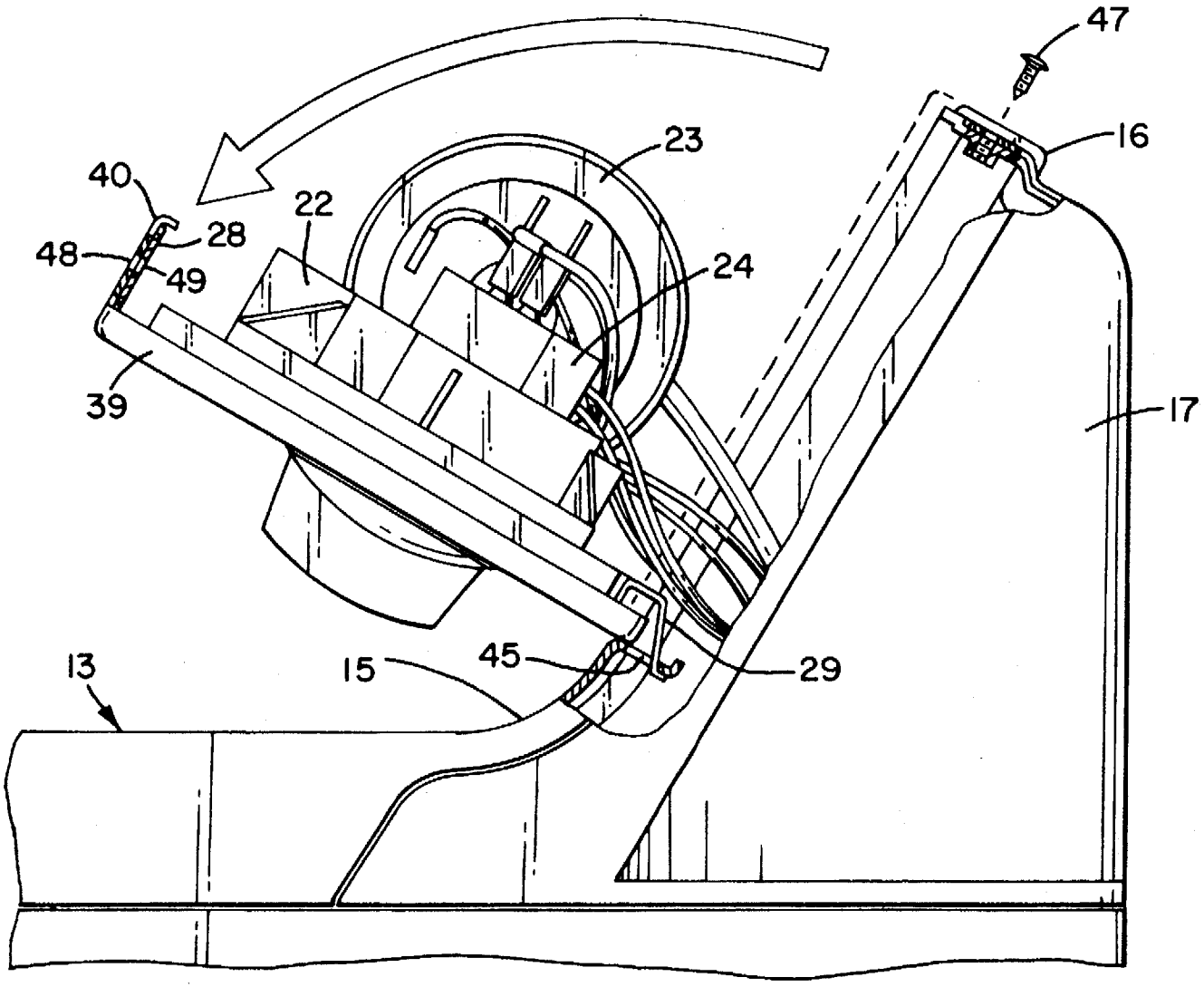
FIG. 3 is a fragmentary side elevation view of the backsplash assembly of the machine of FIG. 1, with the control panel assembly in its open position.

Referring now to FIG. 1, there is shown an automatic clothes washing machine 10 incorporating one form of the present invention. The washing machine includes a cabinet 11 and a control housing 12, often referred to as a backsplash. The housing 11 includes a top member 13 which has a lid 14 to provide access to the interior of the machine. In the illustrative machine, the top member 13 extends completely from side to side of the housing while its rear portion 15 stops forward of the rear of the machine and is upturned.

As best seen in FIG. 2, the backsplash includes an elongated rear wall 16 having its ends joined to a pair of spaced apart end caps 17,18. The rear wall and end cap assembly is mounted to the housing 11 behind the rear portion 15 of top member 13. Additional details of the mounting of the top member and the rear wall/end cap assembly can be had by reference to co-pending application Ser. No. 08/416,057, of Jon Katz et al, entitled Appliance Top Assembly and assigned to General Electric Company, the assignee of the present invention; which application is incorporated herein by reference. The backsplash also includes a control panel assembly 19 which is pivotaly movable between a closed position, against the rear wall 16 and end caps 17,18, as seen in FIG. 1; and an open position away from the rear wall and end caps, as seen in FIG. 2.

Figure 4:
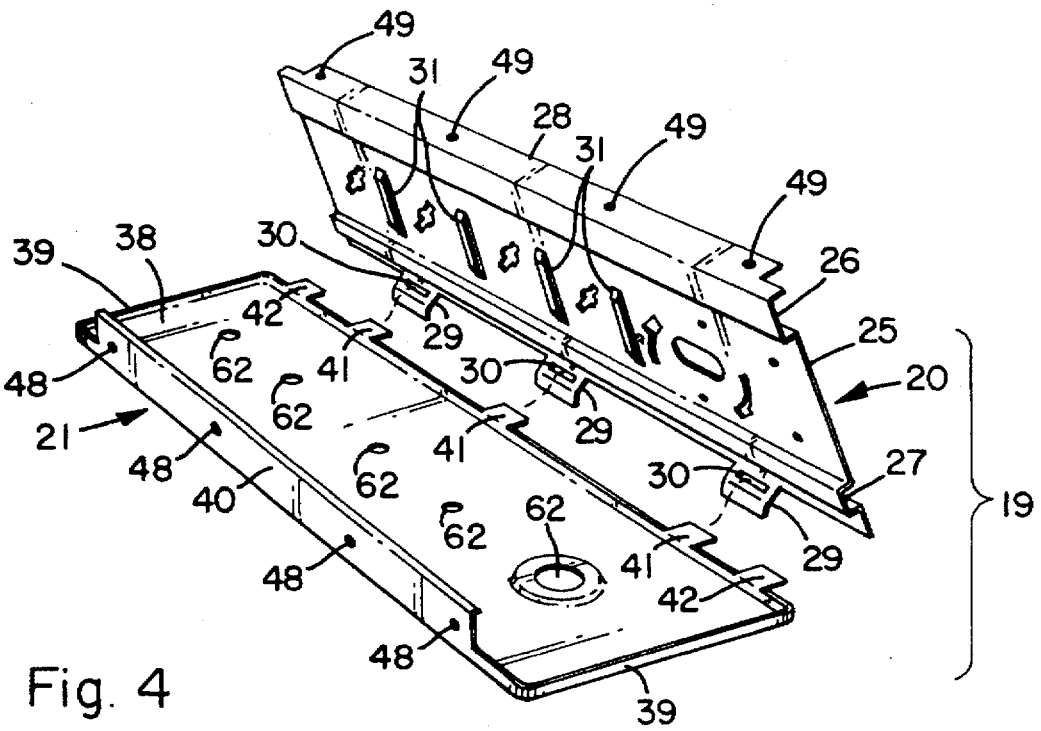
FIG. 4 is an exploded view of the mounting plate and cover of the machine of FIG. 1, with the controls omitted for sake of simplicity.
Figure 5:
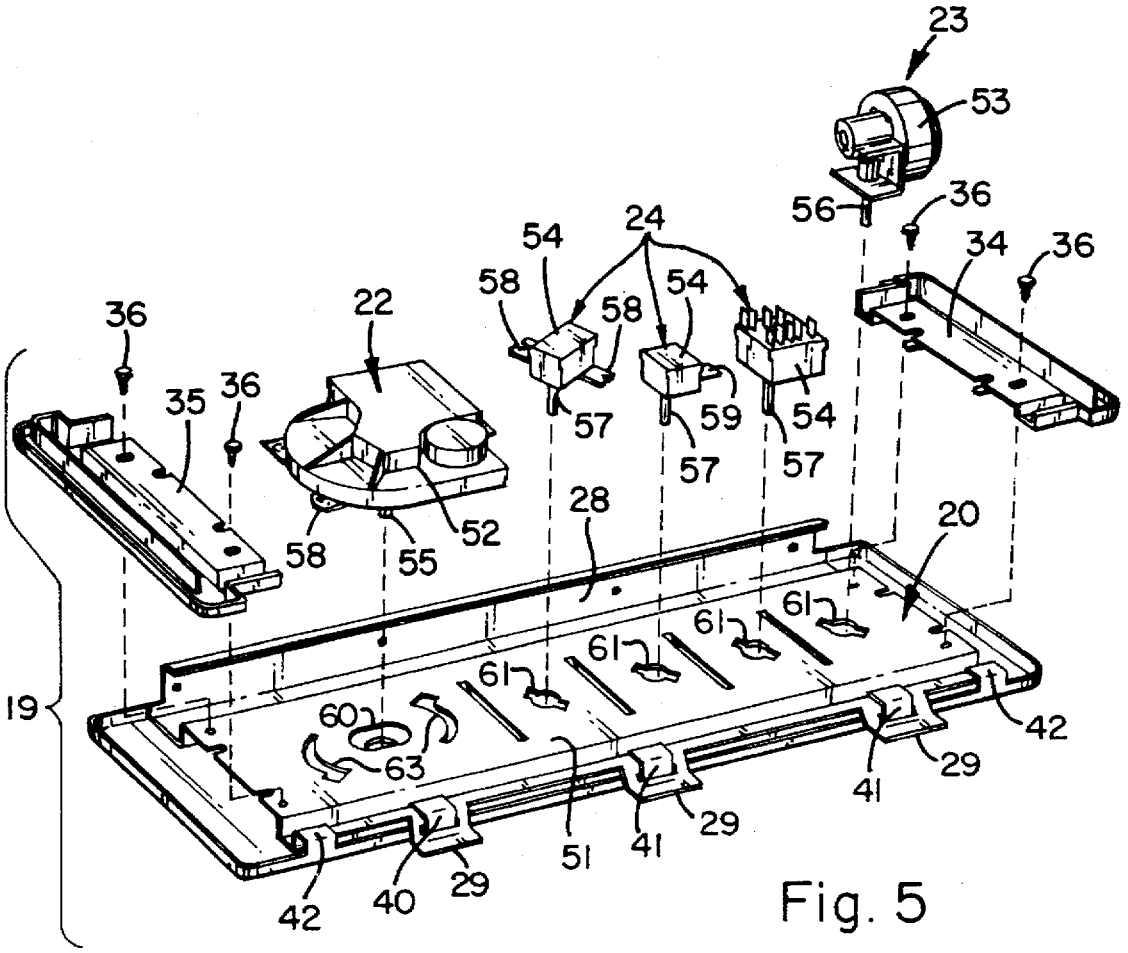
FIG. 5 is an exploded view of the control panel assembly, including various controls.

Referring now to FIGS. 4 and 5, the control panel assembly includes a control mounting plate 20 and a cover member 21. The elongated mounting plate 20 is formed of a relatively heavy metal, such as sheet steel for example, and supports various controls such as timer 22, water level control 23 and rotary switches 24. It will be understood that other clothes washers and other appliances may have different numbers of similar or different controls. The function and internal construction of the particular controls do not form a part of this invention and the particular controls shown are illustrative. The plate 20 includes a planar body 25 with an elongated rib 26 adjacent its top edge and an elongated rib 27 along its bottom edge. A flange 28 projects rearward along the top edge and several spaced apart tabs 29 project downwardly along the bottom edge. A slot 30 extends across each tab 29. Vertical transverse ribs 31 are lanced from plate 20 at locations spaced apart along the body 25. If desired, plastic caps 34,35 are mounted to the ends of plate 20 by suitable means such as screws 36. The caps mesh with top and bottom ribs 26,27 to form a rim completely around plate 20.

The cover member 21 conveniently is formed from a thin sheet of a suitable metal and normally has graphic elements on its front face, including indicia associated with the controls 22–24. The cover 21 is in the form of a planar body 38 surrounded by a rearwardly projecting rim 39. Along the top edge of cover 21, the rim extends into a rearwardly projecting flange 40. A plurality of tabs 41 project downwardly of the lower edge of the rim 39 and correspond to the slots 30 in tabs 29 along the lower edge of plate 20. If desired additional tabs 42 also project downwardly of the lower edge of rim 39.

The plate 20 and cover 21 are assembled by inserting tabs 41 through the slots 30 and rotating the members 20,21 together so that the rim around the edge of mounting plate 20 fits within the rim 39 around cover 21. The tabs 41 are then bent over to secure the members together with flange 28 against flange 40. Also, if present, additional tabs 42 are bent over.

Referring now to FIG. 3, the control panel assembly 19, including mounting plate 20 and cover 21, is mounted on the machine 10 by inserting the tabs 29 into corresponding slots 45 formed in the upturned rear portion 15 of housing top member 13. With such a mounting the control panel assembly 19 is pivotable about the junction of tabs 29 in slots 45 between a closed position shown in FIG. 1, in which the assembly 19 engages the control housing rear wall 16 and end caps 17,18, and an open position shown in FIG. 2, in which the control panel assembly 19 is removed form rear wall 16 and end caps 17,18. The control panel assembly 19 is removably secured in its closed position in engagement with rear wall 16 and end caps 17,18 by screws 47 which pass through openings 48 in flange 40 and openings 49 in flange 28 and are threadedly received in the top of rear wall 16.

It will be understood that many appliance top and backsplash arrangements are well known in the art. For example prior art top members normally are not upturned along their rear edge. In that event a base member can be provided across the lower front edge of the backsplash and include slots to receive the tabs 29.

When control panel assembly 19 is in its open position, as seen in FIGS. 2 and 3, the rear or inner face 51 of the control mounting plate 20 is exposed. The controls, such as those shown at 22–24, are mounted on face 51 and, with the panel assembly open, can be tested and repaired to the extent repairs can be effected without removing the control from plate 20. In order to be able to easily remove the controls for repair or to replace a defective control, the controls are mounted to plate 20 from the exposed inner face 51. In the illustrative embodiment the controls 22–24 include housings 52–54 respectively. Control or operating shafts 55–57 project forward of the housings 52–54 respectively. Ears, such as those shown at 58–59, extend laterally of the front of each control 22–24 on opposite sides of the shafts 55–57 respectively.

The mounting plate has a plurality of openings 60–61 positioned to receive the shafts 55–57 and cover 21 has corresponding openings 62 through which the shafts 55–57 pass. Mounting plate 20 has additional arcuate openings 63 on substantially opposite sides of opening 60 to receive the ears of timer 22. Additional details of this type of mounting arrangement can be obtained from co-pending application Ser. No. 08/416,059, of Jon Katz et al, entitled Appliance Control Mounting and assigned to General Electric Company, the assignee of this invention; which application is incorporated herein by reference. The openings 61 are of the double keyhole type to receive the ears of control housings 53–54. Additional details of such a mounting arrangement may be obtained from U.S. Pat. No. 5,256,841 of John Zanella, entitled Self-Locking Switch Unit, and assigned to General Electric Company, assignee of the present invention; which patent is incorporated herein by reference.

It will be understood that the details of how a particular control is mounted on plate 20 is not of significance to the present invention, so long as the control is mounted from and removable from the exposed face 51. This enables individual controls to be replaced without the necessity of removing the backsplash from the machine or even removing the control panel assembly from the backsplash.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. An appliance backsplash assembly including:

an appliance top member having a rear portion, said rear portion being upturned and having a plurality of spaced apart slots formed therein;

a control housing including a rear wall and a pair of end caps mounted adjacent said rear portion of said appliance top member;

said control housing also including a control panel assembly including a cover with a generally planar body having top and bottom edges, a flange projecting perpendicularly along its top edge and a plurality of tabs depending from its bottom edge;

said control panel assembly also including a control mounting plate with a generally planar body having top and bottom edges, a flange projecting perpendicularly along its top edge and a plurality of spaced apart tabs depending from its bottom edge, each of said mounting plate tabs having a slot therein;

said mounting plate and said cover being assembled with said mounting plate flange positioned against said cover flange and said cover tabs received through said slots in said mounting plate tabs and bent over to secure said mounting plate and said cover together;

said mounting plate tabs being received through corresponding ones of said slots in said rear portion of said top member for selective pivotal movement of said control panel assembly between a closed position engaging said rear wall and end caps and an open position away from said rear wall and end caps, said mounting plate tabs engaging said rear portion of said top member to support said control panel assembly in its open position;

said control mounting plate body having one face exposed when said panel assembly is in its open position; and at least one control mounted to said mounting plate from said one face to be removable when said control panel assembly is in its open position.

2. An appliance backsplash assembly as set forth in claim 1, wherein: fasteners releasably secure said control panel assembly in engagement with said rear wall and end caps.

* * * * *